United States Patent [19]

Grobman

[11] Patent Number: 4,526,102

[45] Date of Patent: Jul. 2, 1985

[54] INK CIRCULATION AND WASH UP SYSTEM FOR A PRESS

[75] Inventor: William Grobman, Philadelphia, Pa.

[73] Assignee: Molins Machine Company, Inc., Cherry Hill, N.J.

[21] Appl. No.: 547,535

[22] Filed: Oct. 31, 1983

[51] Int. Cl.[3] ..... B41F 35/04

[52] U.S. Cl. ..... 101/425; 101/349; 184/35

[58] Field of Search ..... 101/423, 425; 184/35

[56] References Cited

U.S. PATENT DOCUMENTS

| | | | |
|---|---|---|---|
| 1,105,085 | 7/1914 | Loomis | 184/35 |
| 1,887,199 | 11/1932 | Gillam | 184/35 X |
| 1,914,062 | 6/1933 | Ahrensmeyer | 184/35 |
| 1,951,771 | 3/1934 | Reswick | 184/35 X |
| 2,057,643 | 10/1936 | Farnsworth | 184/35 |
| 2,420,970 | 5/1947 | Parker et al. | 184/35 X |
| 2,626,015 | 1/1953 | Erikson | 184/35 |
| 3,418,934 | 12/1968 | Pannier | 101/423 X |
| 3,974,768 | 8/1976 | Grobman | 101/425 |
| 4,369,734 | 1/1983 | Preuss | 101/425 X |

FOREIGN PATENT DOCUMENTS

| | | | |
|---|---|---|---|
| 0739182 | 10/1955 | United Kingdom | 184/35 |

*Primary Examiner*—Clifford D. Crowder
*Assistant Examiner*—James R. McDaniel
*Attorney, Agent, or Firm*—Seidel, Gonda & Goldhammer

[57] ABSTRACT

A printing press has an ink circulation and wash up system wherein excess ink is received in a receptacle associated with fountain rollers. Ink and/or wash up liquid flows by gravity from the receptacle to a valve below the elevation of the receptacle. From the valve, the liquid may return to a source of ink or to a drain.

13 Claims, 4 Drawing Figures

INK CIRCULATION AND WASH UP SYSTEM FOR A PRESS

BACKGROUND

In the manufacture of corrugated paper board containers, sheets of paper board are conveyed through a press auch as a printer slotter wherein one surface of the sheets is printed. A conventional printer slotter includes an ink fountain. The fountain is generally defined by two cooperating rollers and a printing plate roller.

In U.S. Pat. No. 3,974,768 there is disclosed improved apparatus for ink circulation and wash up. The present invention is directed to solution of the problem of how to minimize plumbing and maintenance while retaining desirable features of the system as disclosed in said patent.

SUMMARY OF THE INVENTION

The present invention is directed to a system for distributing a liquid printing medium and a wash liquid in a printing press. The printing press includes application means for applying the printing medium. A plurality of discrete printing medium supply means is provided for sequentially supplying a printing medium to the application means. At least one receptacle is positioned adjacent the application means to receive any excess printing medium therefrom. The receptacle has an outlet. Conduit means is provided for connecting the receptacle with a wash liquid supply means for selectively introducing a wash liquid into the receptacle. A valve is provided below the elevation of the receptacle. A discharge conduit connects the recepticle outlet to an inlet of the valve. The valve has plural outlets. One valve outlet communicates with one of said printing medium supply means. Another valve outlet communicates with another of said printing medium supply means. Another valve outlet communicates with a drain. An actuator is provided for a movable valve member in said valve. The actuator is operable from a location remote from the valve.

Various objects and advantages of the present invention will appear hereinafter.

For the purpose of illustrating the invention, there is shown in the drawings a form which is presently preferred; it being understood, however, that this invention is not limited to the precise arrangements and instrumentalities shown.

DETAILED DESCRIPTION

Figure 1:
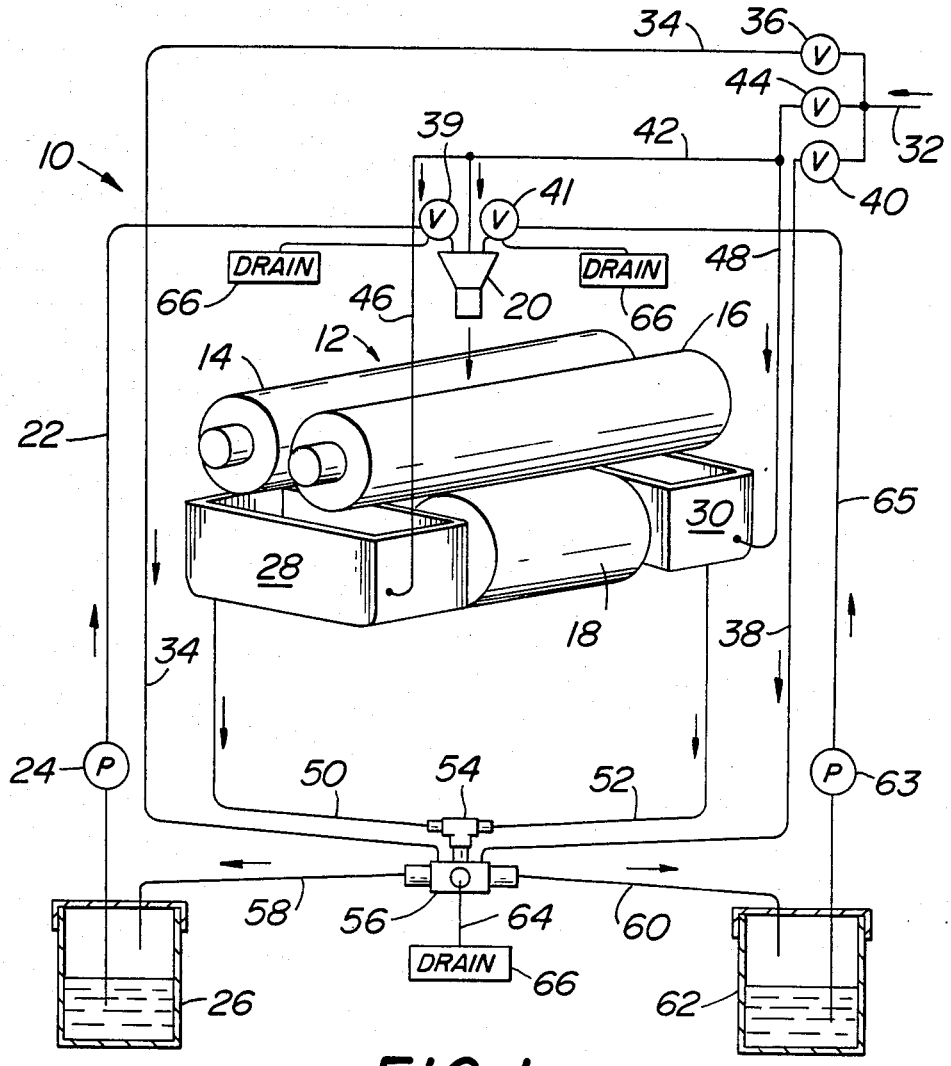
FIG. 1 is a diagramatic illustration of the liquid circulation system in a press.

Referring to the drawing in detail, wherein like numerals indicate like elements, there is shown in FIG. 1 a printing press which is part of a printer slotter. As is conventional, the press 10 includes a plurality of sections each of which is adapted to be moved or separated from one another to facilitate access by an operator. Paper board sheets are sequentially fed to the sections of the printer slotter by means of a feed table.

The press 10 includes a fountain comprised of fountain rollers 14 and 16 supported by a suitable portion of a frame section. A printing plate roller 18 is in frictional contact with one of the rollers such as roller 16. A printing medium such as water soluble ink is introduced to the trough between the rollers 14, 16 by way of a spout 20. Roller 14 performs a metering function and hence could be a stationary doctor blade.

A printing medium such as water soluble ink is directed to the spout 20 by way of conduit 22. The end of conduit 22 remote from spout 20 is connected to the output side of a pump 24. The input side of pump 24 is connected to a container 26. Container 26 contains a supply of a printing medium such as water soluble ink.

A pair of conventional receptacles are supported by a frame section of the press adjacent the ends of the fountain rollers 14, 16. As illustrated, a first receptacle 28 is provided adjacent one end of said fountain rollers while a receptable 30 is provided adjacent the other ends of the fountain rollers. A wash liquid main supply conduit for a wash liquid such as water is provided and designated 32. Conduit 32 communicates with conduits 34, 38, 42 by way of solenoid operated valves 36, 40 and 44 respectively. The valves are operated by way of buttons on a control panel or the like remote from the press 10.

Conduit 42 communicates with spout 20 and with receptacle 28 by way of conduit 46. Conduit 42 also communicates with the receptacle 30 by way of conduit 48. The conduit 42 is above the elevation of the receptacles 28, 30.

Receptacle 28 has an outlet connected to one end of conduit 50. Receptacle 30 has an outlet communicating with one end of conduit 52. The other ends of the conduits 50, 52 are connected to a tee 54. The outlet of tee 54 is connected to the inlet of a multiple outlet valve 56. Valve 56 is mounted on a portion of the press where there is easy access. Tee 54 and valve 56 are below the elevation of receptacles 28, 30 but above the elevation of container 26 so as to take advantage of flow by gravity. Each of the conduits 34 and 38 communicates with discrete inlets to valve 56.

One outlet of valve 56 communicates by way of conduit 58 with the container 26. Another outlet of the valve 56 communicates by way of conduit 60 with a second container 62. Conduits 58 and 60 slope downwardly from valve 56 to their respective containers. Container 62 contains a water soluble printing ink which is colored differently from that in container 26. The liquid printing medium in container 62 is pumped by way of pump 63 and conduit 65 to the spout 20. Pumps 24 and 63 are operable from the aforementioned control panel. Another outlet of the valve 56 communicates with a drain 66 by way of conduit 64.

The valve 56 is provided with an actuator 68 capable of being operated from a remote location such as the aforementioned control panel. The actuator 68 is supported by a portion 70 of the press frame section. Valve 56 is preferably a rotary plug valve whereas the actuator 68 is preferably a reciprocable actuator.

Figure 4:
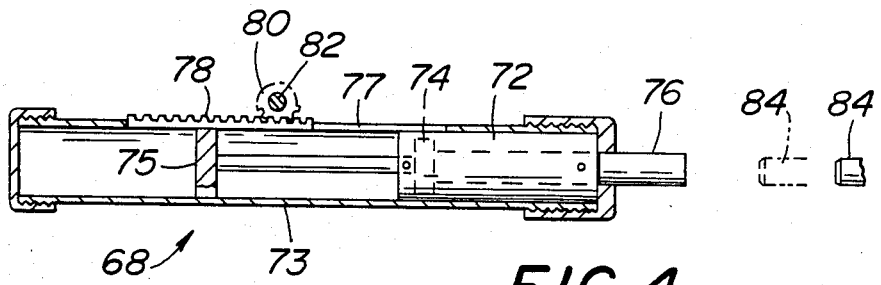
FIG. 4 is a sectional view taken along the line 4—4 in FIG. 2 but on an enlarged scale.

The actuator 68 includes a cylinder 72 mounted within a housing 73 and having a length shorter than the length of housing 73. An inlet and an outlet conduit communicate with ports adjacent opposite ends of the cylinder 72. Within the cylinder 72 there is provided piston 74 connected to a piston rod 76. Rod 76 extends through opposite ends of the cylinder 72. The right hand end of rod 76 is free as shown more clearly in FIG. 4. The left hand end of rod 76 is connected to a guide 75 which rides on the inner surface of housing 73. Guide 75 is provided with one or more peripheral notches as shown so that it does not act as a piston.

Guide 75 is connected to a rack 78 by way of a slot 77 in the housing 73. Rack 78 is meshed with a pinion 80. Pinion 80 is connected to the actuator shaft 82 for the valve 56. Thus, as piston 74 is reciprocated, the actuator shaft 82 for the rotary plug 56 will rotate.

Figure 2:
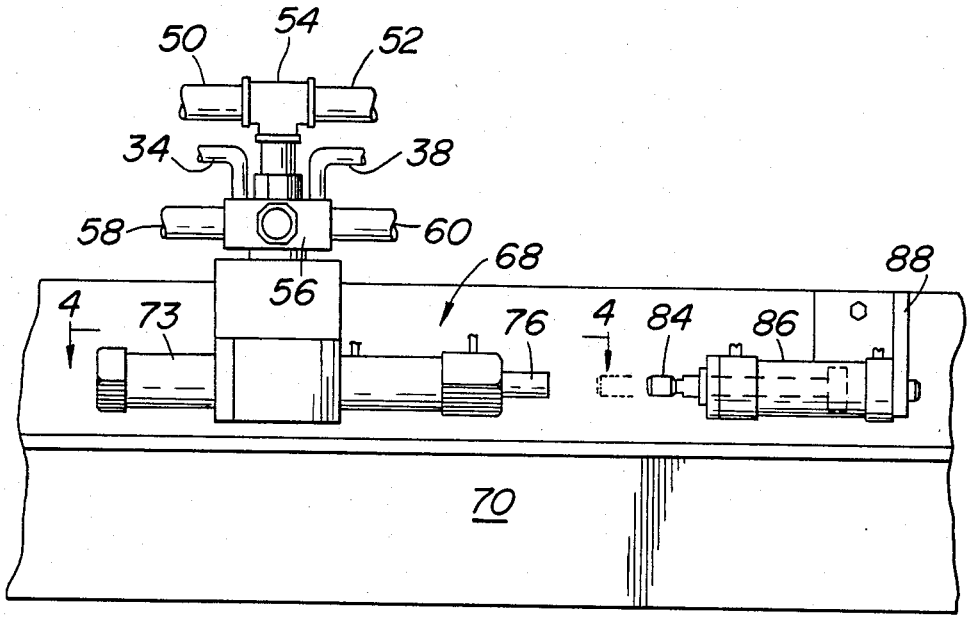
FIG. 2 is an elevation view of the valve and actuator.
Figure 3:
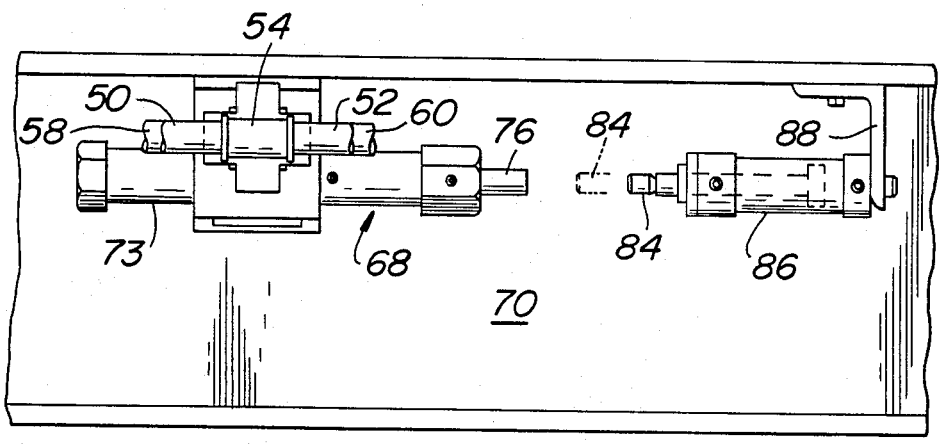
FIG. 3 is a plan view of the valve and actuator.

A cylinder 86 is attached to a bracket 88 on the frame portion 70. See FIGS. 2 and 3. A piston within cylinder 86 has a piston rod 84. Conduits are connected to opposite ends of cylinder 86 so as to move the rod 84 from the solid line position to the phantom position.

In the position of piston 74, all liquid entering the valve 56 is discharged through conduit 58 to container 26. When piston 74 is activated to the extreme right hand position in FIG. 4, all liquid entering the valve 56 is discharged by conduit 60 to container 62. When it is desired to discharge liquid to drain 66, motive fluid at a higher pressure than that in cylinder 72 is introduced into cylinder 86 so as to cause the piston rod 84 to assume the phantom position shown in FIGS. 2–4. When piston rod 84 is in the phantom position as illustrated, it acts as a limit-stop and causes the piston 74 to only travel one half of its normal stroke. When that occurs, all liquid entering valve 56 discharges by way of conduit 64 to the drain 66. Thus, it will be noted that the present invention solves the problem of how to provide a rotary plug valve with three discharge positions while using a reciprocable actuator which normally has only two positions.

The system of the present invention permits the press 10 to be run in a conventional manner with ink being supplied to the fountain rollers 14, 16 from container 26. When a production run is complete, and it is desired to cease using ink from container 26, the press 10 may be converted to a new production run using ink of a different color from container 62. Such conversion is as follows.

The pump 24 is rendered inoperative. Any ink in conduit 22 drains back into the container 26. Any ink in receptacles 28, 30 flows by gravity to the valve 56 and then returns to container 26 by way of conduit 58. Actuator 68 will previously have been operated so as to cause the piston 74 to assume the position shown in FIG. 4.

After all of the ink has returned to the container 26, a button on the control panel is operated so as to introduce motive fluid into the cylinder 86 and thereby move the piston rod 84 to the phantom position shown in the drawings. Thereafter, motive fluid will be introduced into the left hand end of cylinder 72 in FIG. 4 to move the piston 74 to the right. When piston rod 76 engages piston rod 84, the only operative outlet from the valve 56 will be connected to drain 66 by way of conduit 64.

An empty container is substituted for container 26. Thereafter, valves 36, 40 and 44 are actuated at the control panel. Wash liquid such as water is introduced from conduit 32 into the trough between the fountain rollers as well as into the receptacles 28 and 30. The fountain rollers 14 and 16 are cleaned by the wash liquid and excess liquid enters receptacles 28 and 30 and flows by gravity through conduits 50, 52 to the valve 56 and then to drain 66. When the rollers 14, 16 are clean, motive fluid is introduced into the left hand end of cylinder 86 to cause the piston rod 84 to assume the solid line position. Thereafter, piston rod 76 moves from left to right whereby the only operative outlet of the valve 56 will communicate with container 62 by way of conduit 60. Valve 41 is operated to communicate conduit 65 with spout 20. Pump 63 is activated and ink of a different color is pumped to the spout 20. The preferred printing medium is a water-soluble ink and the preferred wash liquid therefore is water. The nature of the wash medium is dictated by the nature of the printing medium which need not be water soluble.

While the press is operating using ink from container 62, a portion of the cleaning cycle is continued. Valve 39 is operated to connect conduit 22 to drain 66. Valve 36 is opened to wash part of valve 56, conduit 58, pump 24 and conduit 22. At this point in time, conduits 22 and 58 communicate with the empty container substituted for container 26. After this portion of the cycle is complete, container 26 is substituted for the aforesaid empty container whose contents are discharged into a drain. Valve 39 is operated so that conduit 22 communicates with spout 20. The press is now ready to commence using ink from container 26 which may be a different color from any of the prior colors used.

When printing resumes with ink from container 26, another portion of the cleaning cycle is continued. An empty container is substituted for container 62. Valve 41 is operated to communicate with drain 66. Valve 40 is opened to wash part of valve 56, conduit 60, pump 63 and conduit 65. After this portion of the cycle is complete, the press is ready for use with a different ink.

The present invention uses a minimum amount of plumbing and is easier to maintain. The components of the valve 56 do not require any maintenance since they are always exposed to the printing medium or wash liquid. Hence, there is no opportunity for printing medium to dry on any of the components of the valve 56 whereby maintenance is minimal. Operation of the system is accomplished at a remote location such as a control panel. There are no conduits or connections to be manually attained when converting from one color ink to another. A large number of presses in use have receptacles like receptacles 28 and 30; those presses may be retrofitted to operate as disclosed herein.

The present invention may be embodied in other specific forms without departing from the spirit or essential attributes thereof and, accordingly, reference should be made to the appended claims, rather than to the foregoing specification, as indicating the scope of the invention.

I claim:

1. A system for distributing a liquid printing medium and a wash liquid in a printing press having elongated printing medium application means supported by the press, a plurality of discrete printing medium supply means for sequentially supplying a printing medium to said application means, a receptacle positioned adjacent each end of said application means to receive any excess printing medium therefrom, each of said receptacles having a single outlet, conduit means connecting each receptacle with a wash liquid supply means for selectively introducing a wash liquid into said receptacles, a valve below the elevation of said receptacles, said valve having a single inlet and plural outlets, discharge conduits connecting each of said receptacle outlets to the inlet of said valve, one valve outlet communicating with one of said printing medium supply means, another valve outlet communicating with another of said printing medium supply means, said valve having another outlet communicating with a drain, and an actuator coupled to a movable member in said valve for selectively connecting the inlet of said valve to a drain or to either one of said printing supply means.

2. A system in accordance with claim 1 wherein said valve is a rotary plug valve.

3. A system in accordance with claim 2 wherein said actuator is a reciprocating actuator coupled to a rotatable shaft in said valve and being operable from a location remote from said valve.

4. A system in accordance with claim 3 including a selectively operable limit stop for causing the actuator to stop intermediate the length of its path of movement.

5. A system in accordance with claim 1 wherein said application means is a pair of fountain rollers, each receptacle being at opposite ends of said fountain rollers.

6. A system in accordance with claim 1 including discrete means for pumping a printing medium from each printing medium supply means to said application means, means including said valve for enabling one pumping means and associated conduits to be cleaned by a wash liquid from said wash liquid supply means while a printing medium is pumped by the other pumping means to said application means.

7. A system in accordance with claim 1 wherein said valve has plural inlets, at least one inlet on the valve being connected to said wash liquid supply means.

8. A system for distributing a liquid printing medium and a wash liquid comprising a printing press having a pair of fountain rollers, a plurality of discrete supply means for sequentially supplying a printing medium to said rollers, each supply means including a pump in a conduit extending from a container of printing medium to said rollers, two receptacles, each positioned adjacent one discrete end of said rollers to receive any excess printing medium therefrom, each of said receptacles having an outlet, conduit means connecting each receptacle with a wash liquid supply means for selectively introducing a wash liquid into said receptacles, a valve below the elevation of said receptacles, discharge conduits connecting said receptacle outlets to a first inlet of said valve, said valve having plural outlets, one valve outlet communicating with one of said printing medium containers, another valve outlet communicating with another printing medium container, an actuator coupled to a movable valve member in said valve, said actuator being operable from a location remote from said valve, means including said valve for enabling one of said pumps and its associated conduit to be cleaned with wash liquid from said wash liquid supply means while a printing medium is pumped by the other pump to said rollers, and a second inlet of said valve being connected to said wash liquid supply means.

9. A system in accordance with claim 8 wherein said valve is a rotary plug valve.

10. A system in accordance with claim 9 wherein said actuator is a reciprocating actuator coupled to a rotatable shaft in said valve.

11. A system in accordance with claim 10 including a selectively operable limit stop for causing the actuator to stop intermediate the length of its path of movement.

12. A system in accordance with claim 1 wherein said movable valve member is a rotary plug and said actuator is mounted for reciprocation, and means for selectively stopping reciprocation of said actuator at a halfway point so that said plug only rotates through one half the distance it normally is rotated by said actuator.

13. A system in accordance with claim 12 wherein said actuator includes a piston responsive to a source of fluid pressure.

* * * * *